US006691397B2

(12) United States Patent
Chakravarti

(10) Patent No.: US 6,691,397 B2
(45) Date of Patent: Feb. 17, 2004

(54) METHOD OF MANUFACTURING SAME FOR PRODUCTION OF CLAD PIPING AND TUBING

(75) Inventor: Bhaven Chakravarti, Bellaire, TX (US)

(73) Assignee: Chakravarti Management, LLC, Bellaire, TX (US)

( * ) Notice: Subject to any disclaimer, the term of this patent is extended or adjusted under 35 U.S.C. 154(b) by 139 days.

(21) Appl. No.: 09/978,803

(22) Filed: Oct. 16, 2001

(65) Prior Publication Data

US 2003/0070278 A1 Apr. 17, 2003

(51) Int. Cl.[7] ..... B23P 25/00; B23P 17/00

(52) U.S. Cl. ..... 29/527.1; 29/421.1

(58) Field of Search ..... 29/421.1, 526.2, 29/526.3, 526.5, 527.1, 527.5, 530; 228/126, 175, 234.1, 265, 127, 131, 156

(56) References Cited

U.S. PATENT DOCUMENTS

| | | | | |
|---|---|---|---|---|
| 3,753,704 A | | 8/1973 | Manilla et al. | |
| 4,536,455 A | | 8/1985 | Maeda et al. | |
| 4,744,504 A | * | 5/1988 | Turner | 228/127 |
| 4,844,863 A | | 7/1989 | Miyasaka et al. | |
| 4,958,060 A | | 9/1990 | Mankins et al. | |
| 4,966,748 A | | 10/1990 | Miyasaka et al. | |
| 5,056,209 A | | 10/1991 | Ohashi et al. | |
| 5,558,150 A | | 9/1996 | Sponseller | |
| 5,584,428 A | | 12/1996 | Satoh et al. | |
| 5,620,805 A | | 4/1997 | Ogawa et al. | |
| 5,988,484 A | * | 11/1999 | Osborn et al. | 228/126 |
| 6,350,327 B2 | | 2/2002 | Neill | |

FOREIGN PATENT DOCUMENTS

| | | | |
|---|---|---|---|
| JP | 405228512 | * | 7/1993 |

* cited by examiner

*Primary Examiner*—John C. Hong
(74) *Attorney, Agent, or Firm*—Welsh & Katz, Ltd.

(57) ABSTRACT

A method of forming clad piping or tubing includes the steps of providing a support billet, finished to a desired, predetermined dimension, having a cladding surface, and providing a CRA cladding material billet, similarly finished to a desired, predetermined dimension. The dimension of the CRA cladding material billet is predetermined such that the CRA cladding material fits onto a cladding surface of the support billet establishing an interface gap. Sealing the interface gap, evacuating the interface gap to form an assembly and Hot Iso-statically Pressing the assembly to metallurgically bond the CRA cladding material billet to the support billet to form a composite billet. The composite billet is extruded at high temperature to form the clad piping or tubing. The clad piping or tubing formed in also disclosed.

22 Claims, 1 Drawing Sheet

METHOD OF MANUFACTURING SAME FOR PRODUCTION OF CLAD PIPING AND TUBING

BACKGROUND OF THE INVENTION

The present invention relates to clad piping and tubing, and more particularly to a composite billet for use in manufacturing clad piping and tubing and a method of manufacturing same.

One method of manufacturing seamless clad piping and tubing is to hot co-extrude a composite billet at high temperature in an extrusion press. A common technique for manufacture of other seamless pipes and tubes. The cylindrical extrusion billet is a composite of carbon or low alloy material on the outside and a corrosion resistant ("CRA") alloy on the inside or vice versa. The range of sizes, wall thicknesses and alloy combinations available in the final product is restricted by the nature and production techniques of the composite billet that is used.

In one exemplary process for billet production as described in Osborn, U.S. Pat. No. 5,988,484, the disclosure of which is incorporated herein by reference, the starting CRA and carbon steel ("CS") cylinders are machined to pre-calculated dimensions that allow for an accurate interference fit. When the CS outer cylinder is heated, it expands at the interface position creating a gap and clearance for it to slip over the CRA inner cylinder. As the assembly cools to room temperature the carbon steel contracts creating an interference fit with the CRA inner cylinder.

Another cladding process describing an outside diameter or OD clad pipe product is disclosed in Sponseller, U.S. Pat. No. 5,558,150, the description of which is incorporated herein by reference. The process is based on centrifugal casting both the clad material and support material, in sequence, to form a composite billet with the support material mechanically lining the CRA material, and without creating a bond between the two materials. As described more fully in Sponseller, the method seeks to inhibit metallurgical bonding and interdiffusion between the support and clad layers by strictly controlling the temperature and time interval between which the layers are consecutively poured.

Several drawbacks have been observed with these processes. For example, during heating of the composite billet in preparation for hot extrusion, the support carbon steel billet material and the CRA cladding material can grow or expand differentially (i.e., at different rates), with the interface between them opening up, as they are only interference fit or mechanically lined rather than metallurgically bonded to each other. This can cause the extrusion to fail, as the CS and CRA materials tend to extrude independent of each other. This is particularly true for composite billets fabricated from two materials with significantly different high temperature thermal expansion and mechanical properties. When the mechanical property differences at extrusion temperatures between the support and clad materials exceed certain limits, the failure rate of extrusions of composite billets increases dramatically. Thus, metallurgical bonding between the support and clad materials in the composite billet substantially increases the likelihood of a successful extrusion.

Accordingly, there is a need for an improved composite billet and method for manufacturing the same. Desirably, such a billet and method of manufacture overcome the drawbacks and failures of known methods and are used to produce high quality composite billets for making clad piping and tubing. More desirably, such a method can be used with a wide variety of base materials and alloys, without adversely affecting the properties and characteristics of either the base material or the clad alloy.

BRIEF SUMMARY OF THE INVENTION

A method for producing a composite billet contemplates using simple and separate steps to produce the starting components, assemble the composite billet and then through the use of a further step of Hot Iso-static Pressing (HIP), create a High Temperature Metallurgical Bond (HTMB) of the billet interfaces prior to extrusion.

The outside support billet can be formed by any technique that can produce a hollow, preferably cylindrical, section. It can be formed from a hollowed or trepanned ingot, a forged, upset, extruded or ring rolled section from such ingot or from a centrifugal casting. Generally, the most cost-effective method of producing the required wall thickness and length of such a cylindrical section will be selected for use. It is not important that the section be forged, as further extrusion during clad piping manufacture will further consolidate the cast microstructure. This support section is finished, such as by machining, to the proper dimensions of the required support material for the assembly of the composite billet.

Similarly, the CRA cylinder that is fitted on to the inner surface of the support cylinder to produce the composite billet, can also be formed by a number of techniques. It can be formed from a hollowed or trepanned ingot or bar, an extruded section or from a centrifugal casting. Again, the most cost-effective method of producing the required wall thickness and length of this CRA cylindrical section will be utilized. Since this section is also further consolidated by extrusion, it is not important that the section be of wrought microstructure. This CRA section is finished, such as by machining, to fit with slight clearance inside the support carbon or low alloy cylinder.

A method of controlling the dimensions of extruded clad piping or tubing includes the steps of providing a support billet and a CRA billet of accurate dimensions, to provide a predetermined amount of base and clad material in forming a composite billet, with the clad material metallurgically bonded to the support billet. The amount of clad material is predetermined based upon the desired inside or outside diameter of the extruded piping or tubing. The composite billet is finished, such as by machining, to precise, predetermined inside and outside dimensions, and the composite billet is extruded.

Without being held to theory, it is believed that the metallurgical bond between the support billet and the CRA inhibits separation of the support billet and cladding material during subsequent hot extrusion of the billet into the clad tubing or piping product. In the absence of such a metallurgical bond, the clad material and the support material, which generally have different high temperature tensile properties and coefficients of expansion, can expand to different degrees. This causes the interface between the materials to open up and the extrusion to fail. In some cases, the clad and support materials can extrude independent of each other resulting in extrusion failure. Such failures become especially pronounced when there are large differences in the high temperature tensile properties of the two materials that are being coextruded, as for example in the case of a carbon steel support and a CRA that contains high nickel and other alloying elements that provides high temperature strength.

By metallurgically bonding the clad material to the support material in forming the composite billet, the present process overcomes many of the difficulties of known composite billet forming processes. The invention also avoids mixing and pickup of alloying elements into the support material from the clad and vice versa and further avoids precipitation of second phases and defects at the interface of the support and clad materials. The invention also allows for a wide range of clad and support materials to be used and results in an economical method of forming clad piping and tubing.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
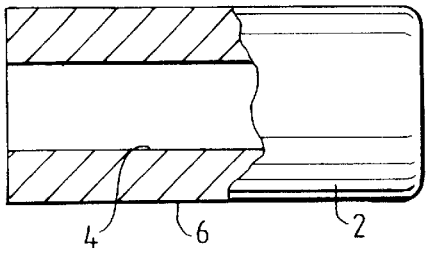
FIG. 1 shows a partial cross sectional view of the support billet prior to assembling into a composite billet.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

Referring to the figures and more specifically to FIG. 1, there is shown a cylindrical support billet 2 that is formed, for example, from a metal ingot, forging, extrusion or centrifugal casting and is finished, such as by machining, to an exact dimension. The support billet, which has an inner surface 4 and an outer surface 6, is formed by removing the center section of the metal ingot or bingot by, for example, heating the ingot or bingot and punching out or trepanning a cylindrical shaped center portion. The inner and outer surfaces 4, 6, respectively, of the cylindrical support billet 2 can then be machined to assure concentricity and dimensions of the finished support billet. The support billet can be formed from any of a variety of materials including carbon steels, carbon manganese steels, low alloy steels, chrome-moly steels, high yield grades, high strength low alloy steels and the like. The dimensions of the billet are as required by the final composite billet dimensions for hot extrusion.

Figure 2:
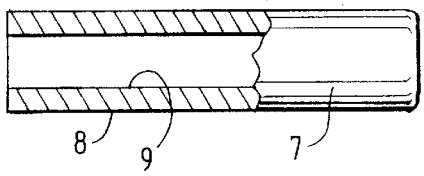
FIG. 2 shows a partial cross sectional view of the CRA billet prior to assembling into a composite billet.
Figure 3:
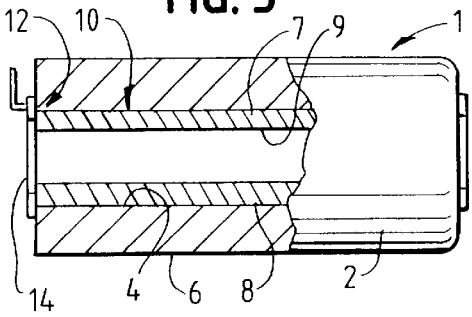
FIG. 3 shows a composite billet with the interface sealed with end caps to exclude air.

Referring to the figures and more specifically to FIG. 2, there is shown a cylindrical CRA billet 7 that is formed from, for example, a metal ingot, forging, extrusion or centrifugal casting and is finished, such as by machining, to an exact dimension. The CRA billet, which has an outer surface 8 and an inner surface 9, can be formed by removing the center section of the metal ingot or bar, for example, by heating the ingot, punching and extruding or trepanning a cylindrical shaped center portion from the bar. The outer and inner surfaces 8, 9, respectively, of the cylindrical CRA billet 7 can then be finished, such as by machining, to assure concentricity and dimensions as required by the final composite billet dimensions for assembly.

The CRA billet 7 can be formed from a variety of corrosion resistant alloys such as, for example, stainless steels, such as austenitic stainless steels, super austenitic stainless steels, duplex stainless steels, ferritic and martensitic stainless steel, chromium containing iron-nickel base alloys such as UNS 08825, chromium containing nickel base alloys, cobalt base alloys, nickel-cobalt base alloys, heat and corrosion resistant chromium containing nickel base, iron/nickel base alloys and the like, Incoloy 825, various nickel based alloys such as Nickel 200, Monel 400, Inconel 625 and Hastelloy C276, which alloys are commercially available from Special Metals Inc. (Huntington, W. Va.) and Haynes International, Inc. (Kokomo, Ind.), and their equivalent generic alloys among others and other intermediate alloys. Those skilled in the art will recognize the wide variety of other cladding materials, including erosion resistant alloys that can also be used.

In carrying out the present method, the CRA billet 7 is slipped inside the support billet 2, and the interface between the two cylinders, indicated generally at 10, is protected from oxidizing (e.g., forming a scale and creating a barrier to bonding) by sealing the two open interface ends 12 by welding end covers 14. The interface 10 gap volume is evacuated to remove any oxygen and the billet 1 is heated for Hot Iso-Static Pressing.

During HIPing operation, the entire assembly (i.e., billet 1) is exposed to a predetermined temperature, for a predetermined amount of time with the concurrent application of high pressure in an autoclave HIP vessel. This uniform (isostatic) application of high pressure at high temperature causes the inside surface 4 of the support billet 2 to bond together with the outer surface 8 of the CRA cylinder 7 by high temperature diffusion bonding. The as-assembled composite billet 1 interfaces metallurgically bond by the Hot Iso-statically Pressing of the CRA cladding alloy billet 7 to the support carbon steel billet inner surface 4. The predetermined temperature and time are based on the properties of the clad material and base material selected. In a current application, in which an API 5L, Grade X65 and higher grades of base material having various wall thickness are bonded with Alloy 825 cladding, the HIP cycle would be at a pressure over about 15,000 psi and at a temperature over about 2000° F. for about at least 2 hours to about 24 hours.

After HIPing, the now composite billet 1 is cooled, the end caps 14 are cut and the composite billet is finished, such as by machining, on the outside surface 6 of the support billet 2 material surfaces. The inside cladding material surface 9 is also finished, such as by machining, to the desired dimensions of the extrusion billet 22.

Figure 4:
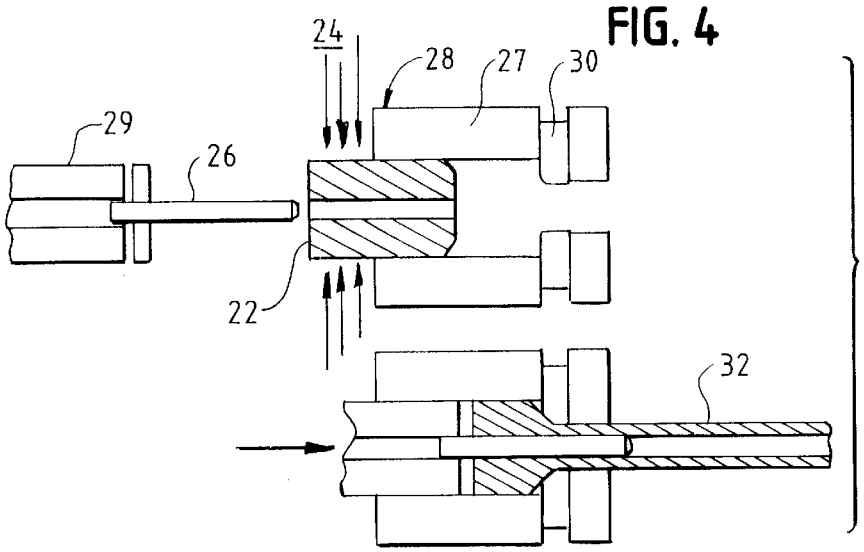
FIG. 4 shows a partial cross sectional view of the HIPed composite billet being hot extruded through an extrusion press.

Referring now to FIG. 4, it is seen that the composite (extrusion) billet 22 is then extruded to form the clad pipe section. In extruding the clad pipe section, the composite extrusion billet 22 is heated (as indicated by lines at 24) to a predetermined extrusion temperature, which depending on the material is generally between 2000° F. and 2200° F., in a furnace. The heated composite extrusion billet is then transferred to an extrusion press 28, where it is placed inside of an extrusion liner or can 27, with the billet in contact with an extrusion ram 29.

A mandrel 26, properly sized to produce the desired inside diameter of the clad pipe section, is placed in the bore of the heated composite extrusion billet 22 and the billet is extruded out through the die 30 and mandrel 26 opening of the extrusion press 28. During hot extrusion of the heated composite extrusion billet 22, both the support and cladding material which are metallurgically bonded, are forced to extrude out in proportion to the die 30 and mandrel 26 opening and other design parameters of the extrusion process. The hot extrusion process exerts very high pressures at high temperatures (generally above about 2000° F. to about 2200° F.). The metallurgical bond formed during the Hot Iso-static Pressing process is further enhanced during the hot extrusion process of producing the clad piping, in that, localized areas between the clad material and the support billet that may not have bonded during the HIP process are healed and the interface bonding of the support material and the cladding material is enhanced.

By utilizing a machined composite extrusion billet 22 with outside and inside dimensions as designed for the extrusion, the variability of the wall ratios between support material and the cladding material are substantially eliminated. This process permits control of the interface dimension and the specific wall thickness required for base material and cladding. This is especially significant if the final pipe produced must meet minimum wall thicknesses for both the support material and the cladding material to be an acceptable product. Having the proper thickness of the two components in the composite billet 22 assures proper wall thickness of the support and clad material in the final product.

Figure 5:
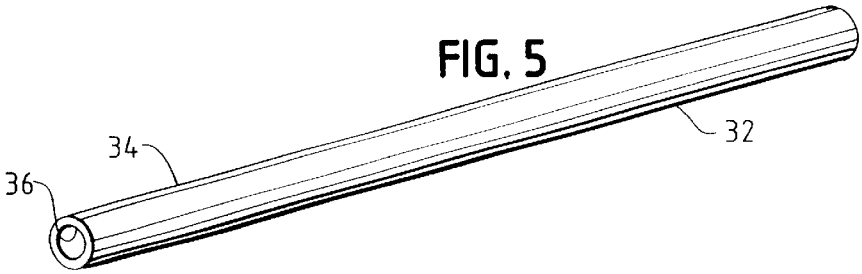
FIG. 5 shows a final clad pipe product.

Referring now to FIG. 5 there is shown a finished clad pipe section 32 formed from a composite billet 22 manufactured in accordance with the principles of the present invention. The clad piping section includes an outer support surface 34 and an inner clad surface 36. In this embodiment, the outer support surface 34 provides support (i.e., stress and pressure boundary), whereas the inner tube 36 provides a corrosion or erosion resistant fluid interface barrier or boundary to the transported fluid.

The extruded clad pipe section can then be further heat treated, blast cleaned on the outside and inside surfaces and tested ultrasonically for quality of bonding created and to identify any defects that may have occurred during extrusion. Standard ultrasonic testing techniques can be used to check bond quality and to identify any potential defects in the clad pipe section. Typically, samples of the material are taken for testing of mechanical and chemical properties.

Figure 6:
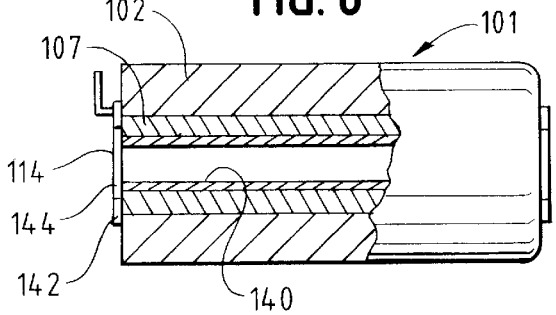
FIG. 6 illustrates an alternate method for producing a composite billet that employs a third cylinder internal to the CRA cladding material for ease of fabrication.

In an alternate method for producing a composite billet 101, a third, thin walled carbon steel cylinder 140 is inserted into the inside of the CRA cylinder. As seen in FIG. 6, this allows the ends caps 114 to be welded between the outside carbon steel support cylinder 102 and the third, inside carbon steel cylinder 140, as indicated generally at 42 and 44, respectively. This reduces the possibility for adverse welding issues vis-a-vis the carbon steel support cylinder 102 and the inner CRA cylinder 107, thus increasing or enhancing the seal welds 42, 44 for oxygen evacuation. This is particularly useful when CRA cylinders 107 of difficult to weld materials are utilized in the manufacture of the composite billets 101.

When such a third CS cylinder 140 is utilized in creating the composite billet 101, the inside CS cylinder 140 is finished, such as by machining, to the required CRA 107 inside diameter surface to prepare the billet 101 for HIPing. After HIPing, the inside CS cylinder 140 is removed for extrusion of the composite billet.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A method of forming clad piping or tubing comprising the steps of:

forming an assembly comprising a support billet, having a cladding surface; and a cladding material billet, sized to cooperate with the cladding surface of the support billet, with an interface gap defined between the cladding material billet and the cladding surface of the support billet;

sealing the interface gap;

evacuating the interface gap;

Hot Iso-statically Pressing the assembly to metallurgically bond the cladding material billet to the support billet to form a composite billet; and extruding the composite billet at high temperature to form the clad piping or tubing.

2. The method in accordance with claim 1 wherein said support billet is formed by centrifugal casting.

3. The method in accordance with claim 1 wherein said support billet is cylindrical.

4. The method in accordance with claim 1 wherein said cladding material is a corrosion resistant alloy and said support material is a carbon or low alloy steel material.

5. The method in accordance with claim 1 wherein said cladding material is an erosion resistant alloy and said support material is a carbon or low alloy steel material.

6. The method in accordance with claim 1 wherein said cladding material billet is cylindrical.

7. The method in accordance with claim 1 wherein the cladding surface is an outer surface of the support billet.

8. The method in accordance with claim 1 wherein the cladding surface is an inner surface of the support billet.

9. The method in accordance with claim 1 wherein the support billet has two cladding surfaces, an inner surface and an outer surface.

10. The method in accordance with claim 1 including the step of a positioning a sealing billet on a aide of the cladding material billet opposite of the support billet such that the cladding material billet is disposed between the sealing billet and the support billet prior to evacuating the interface gap.

11. A product formed by the method of claim 1.

12. A method of controlling the dimensions of extruded clad piping or tubing comprising the steps of:

providing a support billet finished to a desired dimension and having an inner surface;

providing a machined cladding material billet, finished to a desired dimension;

concentrically positioning the cladding material billet and the support billet, with an interface gap defined between the cladding material billet and the support billet;

sealing the interface gap;

metallurgically bonding the cladding material billet to the support billet by a Hot Iso-static Pressing process to form a composite billet;

finishing the composite billet to a predetermined inside dimension and a predetermined outside dimension; and extruding the composite billet to form a dimension controlled extruded clad pipe or tube.

13. The method in accordance with claim 12 wherein the support billet is formed by centrifugal casting.

14. The method in accordance with claim 12 wherein the support billet is cylindrical.

15. The method in accordance with claim 12 wherein the cladding material billet is formed from a material that is a corrosion resistant alloy and the support billet is formed from a material that is a carbon or low alloy steel material.

16. The method in accordance with claim 12 including the step of evacuating the interface gap.

17. The method in accordance with claim 16 including the step of positioning a sealing billet on a side of the cladding material billet opposite of the support billet such that the cladding material billet is disposed between the sealing billet and the support billet prior to evacuating the interface gap.

18. A product produced by the method of claim 12.

19. A method of forming clad piping and tubing comprising the steps of:

providing a support billet having an inner surface;

fitting a solid, corrosion resistant alloy billet inside the support billet;

Hot Isostatic Pressing the corrosion resistant alloy billet against the inner surface of the support billet to metallurgically bond the corrosion resistant alloy billet to the support billet to form a composite billet.

20. The method in accordance with claim 19 further including the steps of trepanning the corrosion resistant alloy portion of the composite billet and then extruding the composite billet to produce a clad pipe section.

21. The method in accordance with claim 19, wherein the support billet is cylindrical.

22. A product of the method of claim 19.

* * * * *